United States Patent [19]

Thienel

[11] Patent Number: 4,527,143

[45] Date of Patent: Jul. 2, 1985

[54] SAFETY FUSE CARTRIDGE

[76] Inventor: Bernhard Thienel, In der Burbach 30, D-5900 Siegen 21, Fed. Rep. of Germany

[21] Appl. No.: 576,008

[22] Filed: Feb. 2, 1984

[30] Foreign Application Priority Data

Aug. 5, 1983 [DE] Fed. Rep. of Germany ... 8322638[U]

[51] Int. Cl.[3] ..... H01H 85/32

[52] U.S. Cl. ..... 337/242; 337/266

[58] Field of Search ..... 337/242, 241, 266; 340/638; 338/226

[56] References Cited

U.S. PATENT DOCUMENTS 4,149,067 4/1979 Jager ..... 338/236

FOREIGN PATENT DOCUMENTS 1923397 11/1970 Fed. Rep. of Germany ..... 337/241

3103478 8/1982 Fed. Rep. of Germany ..... 337/242

*Primary Examiner*—Harold Broome

*Attorney, Agent, or Firm*—Becker & Becker, Inc.

[57] ABSTRACT

A safety fuse cartridge having only a single through-bore necessary in a porcelain body that forms an inner chamber in which a fuse wire, which is embedded in a bed of sand in the chamber, extends between a lower contact base and an upper contact head. The cartridge is provided with an indicator which includes a glow lamp that is connected in parallel to the fuse wire via a high-valued resistor which is also embedded in the same bed of sand. The high-valued resistor can be surrounded by a sleeve or tube of insulating material, especially a tube of silicon or steatite. The resistance value of the resistor is preferably 500 to 1000 megaohms.

13 Claims, 2 Drawing Figures

SAFETY FUSE CARTRIDGE

BACKGROUND OF THE INVENTION

1. Field of the Invention

The present invention relates to a safety fuse cartridge, or a cartridge fuse link, which is provided with a porcelain body in which the fuse wire, which is embedded in sand, extends between a lower contact base and an upper contact end or head; the cartridge is provided with a characterizing indication means, which includes a glow lamp which is connected in parallel to the fuse wire via a high-valued resistor.

2. Description of the Prior Art

With a safety fuse cartridge of this general type, which is known from German Offenlegungsschrift No. 31 03 478 belonging to the Assignee of the present application, the small colored plates which have been used for a long time as an indicating pin which is to break when the fuse blows, are replaced by a glow lamp. This glow lamp is connected in series with a high-valued resistor which, in conformity with Ohm's law, is such that, with regard to the current required for the glow lamp, it nullifies the potential difference between the voltage of the line in which the safety fuse cartridge is disposed, and the glow potential of the glow lamp (which is, for example, 60 volts).

With this heretofore known safety fuse cartridge, the optical inspection of the operation thereof is considerably facilitated, since a defective fuse now actively lights up when the fuse is blown (as long as an external short-circuit is still maintained, and/or an external load is connected). Thus it is also possible under conceivable unfavorable conditions to determine reliably whether the fuse is still operable, or whether it has already been blown.

However, a drawback to the heretofore known safety fuse cartridges is, on the one hand, the space arrangement of the high-valued resistor, and, on the other hand, the dissipation of the (joulean) heat generated by this high-valued resistor. Thus, with the heretofore known safety fuse cartridges, a separate hole is provided in the porcelain body for the high-valued resistor; this, however, requires additional expense, namely greater tool costs, greater piece costs for the porcelain body, etc. In addition, the heat generated by the high-valued resistor does not dissipate well, because, as is known, porcelain is a poor heat conductor. Futhermore, this heat dissipation takes place unevenly, because the high-valued resistor, for reasons of installation, is typically disposed purely by chance on a surface line of that inner bore of the porcelain body associated therewith; however, this resistor is otherwise separated from the wall of the inner bore by means of a crescent-shaped air space.

Starting from this, it is an object of the present invention to avoid the drawbacks of the heretofore known safety fuse cartridges, and to provide a safety fuse cartridge which, while being more economical to produce, provides a better heat dissipation of the heat which is produced when the glow lamp burns, i.e. when the fuse is blown.

BRIEF DESCRIPTION OF THE DRAWING

This object, and other objects and advantages of the present invention, will appear more clearly from the following specification in conjunction with the accompanying drawing, in which.

SUMMARY OF THE INVENTION

Figure 1:
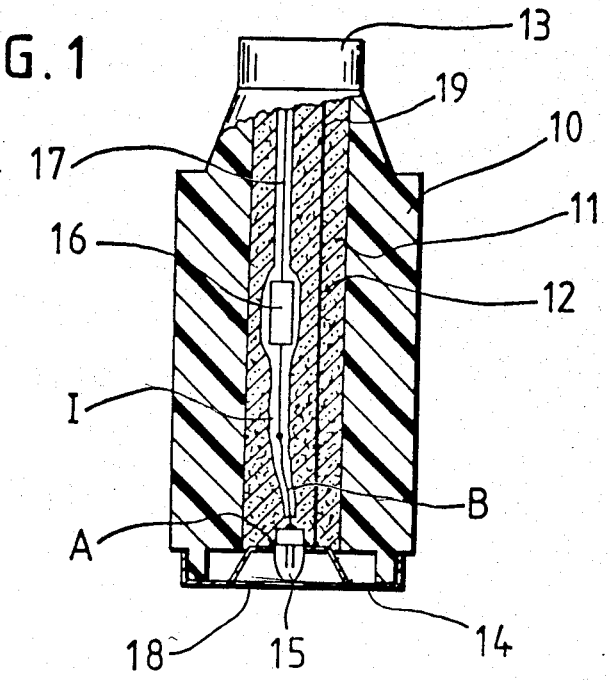
FIG. 1 is a sectional view illustrating one embodiment of a safety fuse cartridge of the present invention.

The safety fuse cartridge of the present invention is characterized primarily in that the high-valued resistor is also embedded in the sand.

Thus, the fuse wire and the high-valued resistor inventively disposed are in the same bed of sand. As a result, only a single through-bore is necessary in the porcelain body; this single-bore serves at the same time for both the fuse wire and the high-valued resistor. Moreover, the heat generated by the high-valued resistor is uniformly dissipated on all sides through the sand, so that the resistor cannot heat up unevenly. This dissipation of the heat in all directions is known, being utilized for the fuse wire, since the latter in practice can also heat up. However, since as long as the fuse is intact only the fuse wire can heat up, and when the fuse is damaged only the high-valued resistor can heat up, an addition of the amount of heat generated does not occur; in this connection, the sand bed which is present with the known safety fuse cartridge is now also advantageously used when the fuse wire has melted.

Pursuant to an advantageous further development of the present invention, the high-valued resistor may be surrounded by a tube of insulating material, especially a silicon or steatite tube. This provides a protection against arcing over. Furthermore, the connection ends of the glow lamp, especially that connection end which is connected directly with the high-valued resistor, also can be surrounded by a tube of insulating material, again especially a tube of silicon or steatite. Particularly advantageous is a continuous sleeve of insulating material which surrounds both the high-valued resistor and that connection end of the glow lamp associated therewith. In this way, arcing over is avoided; in particular, the junction of the high-valued resistor and the glow lamp is protected.

Pursuant to a further feature of the present invention, the resistance value of the high-valued resistor is 500 to 1000 megaohms. This value is designed for a 220 volt power supply. At higher or lower power-supply voltages, the resistance value is proportionately increased or decreased. The stated resistance values, which are somewhat greater than the resistance values disclosed in German Offenlegungsschrift No. 31 03 478, have proven satisfactory in practice.

The glow lamp advantageously is disposed centrally on the front end of the cartridge, especially in the center of the contact end or head. Since the fuse cartridge is generally retained by a screw cap which is provided with a viewing window, the inventive arrangement of the glow lamp affords a particularly good visibility.

In order to make the amperage which is proper for the fuse recognizable, the glow lamp is preferably encircled by a colored identification ring.

Finally, the inner diameter of the cylindrical inner chamber of the porcelain body, in which is disposed not only the fuse wire but also the high-valued resistor, and which contains the sand, is advantageously greater than the inner diameter of the inner space of the porcelain body of the heretofore known safety fuse cartridge. In particular, this inner diameter is only slightly less than the outer diameter of the contact base, being at most 20% less than the outer diameter of the contact base.

DESCRIPTION OF PREFERRED EMBODIMENTS

Referring now to the drawing in detail, the illustrated safety fuse cartridge comprises a porcelain body 10 in which a fuse wire 12, which is embedded in fine or close sand 11, extends between a lower contact base 13 and an upper contact end or head 14. A glow lamp 15 is centrally disposed in the contact head 14. The one connection end A of the glow lamp 15 is connected to the contact head 14. The outer connection end B extends into the sand 11, which is located in an inner chamber of the porcelain body 10. The connection end B is connected to a high-valued resistor 16, the resistance value of which is in the aforementioned range. The high-valued resistor is preferably surrounded by a sleeve or tube of insulating material I. The other end of the high-valued resistor 16 is connected to the lower contact base 13 via a lead 17. The fuse wire and the lead 17 preferably are combined at this location to form a single lead, in order to facilitate assembly of the cap-like contact base. The glow lamp 15 is encircled by a colored identification ring 18, the color of which is characteristic for a specific amperage.

Figure 2:
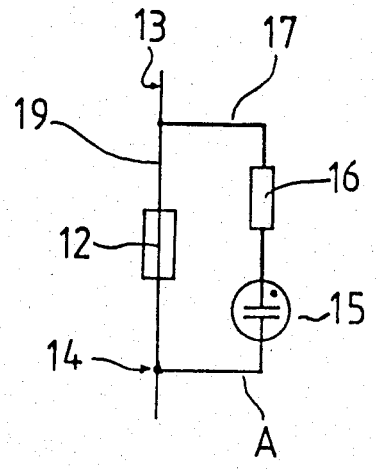
FIG. 2 is a circuit diagram for the safety fuse cartridge of FIG. 1.

When the operating current in the current path 19 (FIG. 2) exceeds the rated current for which the safety fuse cartridge is designed, the fuse wire 12 melts, so that the contact head 14 and the contact base 13 are no longer connected by a lead. As a result, the full power supply voltage exists between the two contacts and is relayed via the high-valued resistor 16 and the glow lamp 15. The glow lamp 15 lights up, so that the failure of the fuse cartridge is recognizable optically. As shown in FIG. 1, the inner diameter of the inner chamber of the porcelain body is only slightly less than the outer diameter of the contact base 13. Thus, in contrast to the heretofore known safety fuse cartridges, pursuant to a preferred embodiment of the present invention, the inner diameter of the inner chamber is greater.

The present invention is, of course, in no way restricted to the specific disclosure of the specification and drawing, but also emcompasses any modifications within the scope of the appended claims.

What I claim is:

1. A safety fuse cartridge, comprising:

a porcelain body having only a single through-bore necessary therein that forms an inner chamber, which contains a bed of sand and which includes a lower contact base and an upper contact end;

a fuse wire, which is embedded in said bed of sand and extends between said contact base and said contact end;

an indicator in the form of a glow lamp; and a high-valued resistor, which also is embedded in said bed of sand, and via which said glow lamp is connected parallel to said fuse wire, said fuse wire and said high-valued resistor being disposed in the same bed of sand which assures not only that heat generated by said high-valued resistor is uniformly dissipated on all sides through the sand so that said resistor cannot heat up unevenly but also the same bed of sand is used advantageously when said fuse wire has melted.

2. A safety fuse cartridge according to claim 1, which includes a tube of insulating material which surrounds said high-valued resistor.

3. A safety fuse cartridge according to claim 2, in which said tube of insulating material is a silicon tube.

4. A safety fuse cartridge according to claim 2, in which said tube of insulating material is a steatite tube.

5. A safety fuse cartridge according to claim 2, in which said glow lamp is provided with two connection ends, at least one of which is surrounded by a tube of insulating material.

6. A safety fuse cartridge according to claim 5, in which said tube of insulating material is a silicon tube.

7. A safety fuse cartridge according to claim 5, in which said tube of insulating material is a steatite tube.

8. A safety fuse cartridge according to claim 5, in which one of said connection ends of said glow lamp is connected to said high-valued resistor, with the latter and said last-mentioned end of said glow lamp being surrounded by one and the same tube of insulating material.

9. A safety fuse cartridge according to claim 1, in which the resistance value of said high-valued resistor is from 500 to 1000 megaohms.

10. A safety fuse cartridge according to claim 1, in which said glow lamp is centrally disposed on one of said contact base and said contact end of said porcelain body.

11. A safety fuse cartridge according to claim 10, in which said glow lamp is disposed in said contact end.

12. A safety fuse cartridge according to claim 1, in which said glow lamp is encircled by a colored identification ring.

13. A safety fuse cartridge according to claim 1, in which said porcelain body is provided with a cylindrical inner chamber for receiving said bed of sand; the inner diameter of said inner chamber being at most 20% less than the outer diameter of said contact base.

* * * * *